US012669259B1

(12) United States Patent
Northrup

(10) Patent No.: US 12,669,259 B1
(45) Date of Patent: Jun. 30, 2026

(54) VENTILATION PARTITIONING ASSEMBLIES

(71) Applicant: Northrup Incorporated, Dallas, TX (US)

(72) Inventor: Robert Northrup, Dallas, TX (US)

(73) Assignee: Northrup Incorporated, Dallas, TX (US)

( * ) Notice: Subject to any disclaimer, the term of this patent is extended or adjusted under 35 U.S.C. 154(b) by 0 days.

(21) Appl. No.: 19/354,979

(22) Filed: Oct. 10, 2025

(51) Int. Cl.
*F24F 13/08* (2006.01)

(52) U.S. Cl.
CPC ..... *F24F 13/08* (2013.01)

(58) Field of Classification Search
CPC ..... F24F 13/08; B60H 1/00592
USPC ..... 454/254, 284, 307
See application file for complete search history.

(56) References Cited

U.S. PATENT DOCUMENTS 1,561,006 A * 11/1925 Mcnutt ..... F23L 17/10 454/22
1,650,569 A * 11/1927 Nickle ..... F24D 19/0085 454/307
2,080,726 A 5/1937 Lowinger
2,245,470 A * 6/1941 Fuchs ..... F24D 5/04 454/243
2,504,472 A * 4/1950 Van Alsburg ..... F24F 13/062 454/302
3,010,378 A * 11/1961 Geocaris ..... F21V 33/0092 362/365
3,358,578 A 12/1967 Meyer
3,545,470 A * 12/1970 Paton ..... F16K 11/052 137/484.2
3,648,591 A * 3/1972 Winnett ..... F24F 7/065 55/385.2
3,680,468 A * 8/1972 Schueler ..... B60H 1/00364 454/324
3,768,235 A * 10/1973 Meyer ..... B01D 46/12 160/228
4,060,025 A * 11/1977 Pelosi, Jr. ..... F24F 7/10 454/294
4,142,456 A 3/1979 Locker
(Continued)

FOREIGN PATENT DOCUMENTS

DE 4401982 A1 * 6/1994 ..... F24F 13/081
JP 2017180905 A 10/2017

OTHER PUBLICATIONS

H. Lee and Awbi, Effect of internal partitioning on indoor air quality of rooms with mixing ventilation—basic study. Building and Environment 39 (2004). pp. 127-141 (c) 2003 Elsevier Ltd, (Year: 2004).*

(Continued)

*Primary Examiner* — Michael G Hoang
*Assistant Examiner* — Frances F. Hamilton

(57) ABSTRACT

Ventilation partitioner assemblies and methods for enhancing airflow distribution from HVAC and/or other climate control systems are disclosed. The ventilation partitioner assemblies include integrated director and deflector portions. The director portion can redirect high-velocity air streams tangentially along contiguous surfaces, utilizing the Coanda effect for extended reach and improved occupant comfort. The deflector portion diffuses peripheral airflow, promoting uniform air distribution and minimizing drafts.

20 Claims, 11 Drawing Sheets

(56) References Cited

U.S. PATENT DOCUMENTS 4,182,227 A * 1/1980 Roy ..... F24F 13/06 454/302
4,316,407 A * 2/1982 Lambert ..... F24F 13/072 454/303
4,502,368 A 3/1985 Hempel
4,512,356 A * 4/1985 Widerby ..... F24F 13/08 137/75
D281,999 S 12/1985 Shames et al.
4,693,174 A 9/1987 Anderson
5,033,361 A 7/1991 Moszkowski
5,046,405 A * 9/1991 Roy ..... F24F 13/06 454/304
5,323,761 A * 6/1994 Vartiainen ..... F24F 13/06 454/67
5,368,072 A * 11/1994 Cote ..... F16K 11/0655 137/872
5,577,958 A * 11/1996 Kumekawa ..... F24F 13/081 454/304
6,264,551 B1 7/2001 Smith
6,554,880 B1 * 4/2003 Northcutt ..... B01D 46/10 55/DIG. 35
7,407,001 B2 8/2008 Newman et al.
7,487,620 B2 * 2/2009 West ..... F24F 7/02 454/9
7,635,298 B2 * 12/2009 Henneberry ..... F24F 13/06 454/307
7,651,390 B1 1/2010 Profeta et al.
8,087,878 B2 1/2012 Chen
8,882,573 B2 * 11/2014 Barfield ..... F24F 13/18 454/248
8,936,506 B2 * 1/2015 Zibafar ..... F23L 17/02 454/17
10,309,684 B1 6/2019 Taylor, Jr.
11,370,274 B2 6/2022 Nakashima
11,376,925 B2 * 7/2022 Williamson ..... B60H 1/245
11,433,740 B2 9/2022 Paris
2001/0023173 A1 * 9/2001 Schiedegger ..... F24F 7/065 454/367
2002/0069599 A1 6/2002 Dhallan
2004/0014418 A1 1/2004 Farag et al.
2008/0227382 A1 9/2008 Profeta et al.
2009/0042505 A1 2/2009 Henneberry
2016/0121697 A1 * 5/2016 Yamamoto ..... F24F 13/081 454/155
2017/0276389 A1 * 9/2017 Yamamoto ..... F24F 11/70
2020/0292197 A1 9/2020 Wilson et al.
2021/0131697 A1 * 5/2021 Kim ..... F24F 13/06
2024/0027095 A1 * 1/2024 Badenhorst ..... F24F 13/08
2025/0067465 A1 * 2/2025 Campbell ..... F04D 25/08

OTHER PUBLICATIONS

Man Fan, et al. "A review of different ventilation modes on thermal comfort, air quality and virus spread control". Build Environ. Mar. 15, 2022. pp. 1-23. Online. Available at https://pmc.ncbi.nlm.nih.gov/articles/PMC8799382/.

* cited by examiner

VENTILATION PARTITIONING ASSEMBLIES

TECHNICAL FIELD

This disclosure is related to the field of heating, ventilation, and air conditioning (HVAC) and, more particularly, to ventilation partitioner assemblies for directing air flows received from climate control systems. In certain embodiments, the ventilation partitioner assemblies can be mounted or installed on various surfaces, such as ceiling, wall, and/or floor surfaces, to direct airflows from central air conditioning (AC) systems, forced-air heating systems, heat pump systems, and/or other types of climate control systems.

BACKGROUND

The field of climate control systems encompasses technologies and systems used to manage and regulate indoor environmental conditions, such as temperature, humidity, and air movement, across a variety of settings including residential, commercial, and industrial spaces. Climate control systems typically incorporate equipment and components such as air conditioning units, heating systems, ventilation devices, and control mechanisms that attempt to optimize comfort and air quality for occupants. These systems play a vital role in maintaining desirable indoor climates, supporting energy efficiency, and meeting established standards for environmental performance and occupant well-being.

A prevalent challenge in climate control systems is the inefficient distribution of airflow within a room or environment that receives conditioned air from the climate control system. The non-uniform and inefficient distribution of air flow can often lead to uneven temperature gradients and inconsistent comfort levels throughout an indoor space. Despite the use of advanced equipment and control mechanisms, many conventional systems struggle to deliver air uniformly, resulting in areas that are either over-conditioned or under-conditioned. This lack of balanced airflow can cause certain zones to experience drafts, stagnant air, or temperature fluctuations, ultimately diminishing occupant comfort and reducing the overall effectiveness of the climate control system.

Various types of devices and mechanisms have been developed that unsuccessfully solve the challenge of non-uniform and/or inefficient distribution of air flow in an environment.

Conventional supply registers, vents, diffusers, and similar devices—often referred to as grilles, vent covers, or deflectors—are commonly installed at the outlets of climate control systems to distribute conditioned air into a room. These components typically feature fixed or limited louver controls that restrict the ability to adjust airflow direction, and their physical structure can impede the outflow of air by introducing obstructions.

Additionally, most conventional designs are based on the principles of mixing ventilation, which aims to blend the entire room's air to a uniform temperature from floor to ceiling. However, when installed in ceilings, these diffusers often direct air downward, causing it to tumble and mix with ambient air in circular patterns. This approach frequently results in uncomfortable drafts and uneven air distribution, as well as diminished control over where conditioned air is delivered, ultimately failing to address the challenge of achieving balanced and efficient airflow throughout the space.

Recent research aimed at improving mixing ventilation has explored approaches such as intermittent ventilation, personal ventilation devices for desks and clothing, stratum ventilation directed at office workers, and high-powered impinging jet ventilation across floors. These methods represent efforts to achieve both enhanced occupant comfort and more efficient delivery of thermal conditioning within indoor environments. However, these approaches have not effectively resolved the persistent issues of non-uniform airflow and occupant discomfort. Furthermore, many of these solutions require the installation of complex mechanisms, such as servos, jets, or unnecessarily sophisticated active flow control systems, which add cost and complexity without adequately addressing the underlying problem. Ideally, a solution to this problem would achieve balanced and efficient airflow throughout a space without introducing unnecessary complexity or requiring extensive modifications to existing systems.

In addition to failing to adequately address the problem, some attempted solutions have introduced factors that may negatively impact occupant health.

Certain conventional ventilation strategies, such as mixing ventilation, have been shown to inadvertently promote the spread of airborne contaminants and pathogens due to the creation of randomized turbulence and ineffective downdrafts. In contrast, wall-attached ventilation techniques can help balance the mean radiant temperature (MRT) within a room while simultaneously reducing the concentration of airborne germs by improving ventilation efficiency and minimizing uncomfortable drafts. Downdrafts that do not directly interact with occupants are particularly effective at carrying atomized droplets containing viruses and bacteria to the floor, where they are less likely to be inhaled and can be safely sequestered.

These findings highlight the importance of ventilation design not only for thermal comfort but also for occupant health. Solutions that fail to control airflow patterns or that generate excessive turbulence may inadvertently increase the risk of disease transmission within indoor environments. Ideally, an optimal solution to the problem of fixing non-uniformity in air flow distribution would be able to achieve balanced and efficient airflow throughout a space without promoting the spread of airborne contaminants, pathogens, or the like.

Various standards have been promulgated that establish acceptable indoor environmental conditions, air quality, and ventilation requirements.

ASHRAE 55 (ANSI/ASHRAE Standard 55: Thermal Environmental Conditions for Human Occupancy) and related standards establish criteria for indoor environmental conditions that are considered thermally comfortable for occupants. These standards specify acceptable limits for radiant (surface) and air temperature asymmetries to ensure comfort. For example, according to ASHRAE 55, the maximum allowable radiant temperature difference is 9° F. for ceilings relative to an opposing floor or wall, reflecting human sensitivity to hot ceilings. The standard also sets limits of 25° F. for cool ceilings, 10° F. for warm walls, and 41° F. for cool walls. Additionally, for air temperature, the difference between 4 inches and 67 inches above the floor (from ankle to head height) should not exceed 5.4° F.

ASHRAE 62 (ASHRAE 62.1—Ventilation for Acceptable Indoor Air Quality and ASHRAE 62.2—Ventilation and Acceptable Indoor Air Quality in Residential Buildings) and related ventilation standards recommend a minimum of 0.003 CFM per square foot to address building-related pollutants, and 7.5 CFM per person to address occupant-related pollutants. These guidelines correspond to "air changes per hour" (ACH), with typical residential values ranging from 0.3 to 0.5 ACH. Areas with stagnant air (e.g., such as behind curtains in a bay window during winter) tend to be cold, humid, and still, creating conditions that can promote mold growth.

Many existing climate control systems fall short of meeting established standards for indoor environmental quality and ventilation. Passive cooling and heating systems often result in nonuniform radiant and air temperatures and typically lack adequate ventilation. Radiant floors and panels, whether using circulating thermal fluid or electric resistance heating, require supplemental measures such as fans, open windows, leaky surfaces, or energy recovery ventilators (ERVs) to mitigate the buildup of indoor $CO_2$ and other pollutants. Radiant cooling systems, which depend on surfaces cooler than the ambient room temperature, can lead to condensation below the dew point—commonly in the 50-60° F. range—resulting in mold growth on those surfaces. In contrast, central air conditioning systems manage condensate drainage and latent humidity loads more effectively. Modern two-speed and variable-speed air handlers provide more continuous air circulation at lower speeds compared to traditional single-speed units. Overall, radiant systems are best used as a supplement to, rather than a replacement for, comprehensive HVAC solutions.

Radiant heating systems tend to deposit most of their heat into the adjacent ceiling, which serves as the nearest absorptive surface, even when reflective devices are used. This results in inefficient heat distribution. Additionally, all existing radiant devices require professional installation, including wiring or plumbing through attics and walls, as well as precise alignment of drill-hole templates with anchors and brackets to secure their panels. If radiant devices could be eliminated entirely and existing ventilation systems utilized to achieve desirable surface temperatures in specific zones or throughout a room, it would be possible to reduce uncomfortable temperature asymmetries while also simplifying climate control and lowering associated costs.

Heat pumps, which are essentially air conditioners equipped with reverse valves, share several drawbacks with radiant systems. Although marketed as an advantage, the process of piping compressed refrigerant throughout a building to individual room air handlers results in each room recirculating its own air, rather than promoting whole-building ventilation. These systems offer limited filtration options, as the compact design of split air handler units cannot accommodate sufficient return air area for effective filters. Condensate must be routed and often pumped through tubes in walls and attics, and mold buildup is common on evaporators, which are difficult to access and clean. Furthermore, heat pumps cannot be installed on floors, require reinforced and specialized ceiling installations, and feature return air flow that is conjoined and adjacent to supply air flow. These factors significantly restrict their flexibility and limit their ability to provide adequate ventilation and air exchange throughout a space.

In view of the foregoing, there is a need for an improved ventilation solution that can:

a. overcome problems associated with the unbalanced, non-uniform, and/or inefficient airflow throughout a space while promoting occupant comfort;
b. operate without constricting airflow or introducing unnecessary complexity;
c. avoid the need for extensive modifications to existing systems or ductwork;
d. prevent undue static pressure on the air handler and maintain overall system ventilation capacity;
e. reduce or mitigate the risk of spreading airborne contaminants or pathogens; and
f. enable simple, straightforward installation without complicated procedures and at a low cost.

The background description provided herein is for the purpose of presenting the context of the disclosure. The materials described in this section are not prior art to the claims in this application and are not admitted to be prior art, or suggestions of the prior art, by inclusion in this section.

BRIEF DESCRIPTION OF DRAWINGS

To facilitate further description of the embodiments, the following drawings are provided, in which like references are intended to refer to like or corresponding parts, and in which.

Figure 1A:
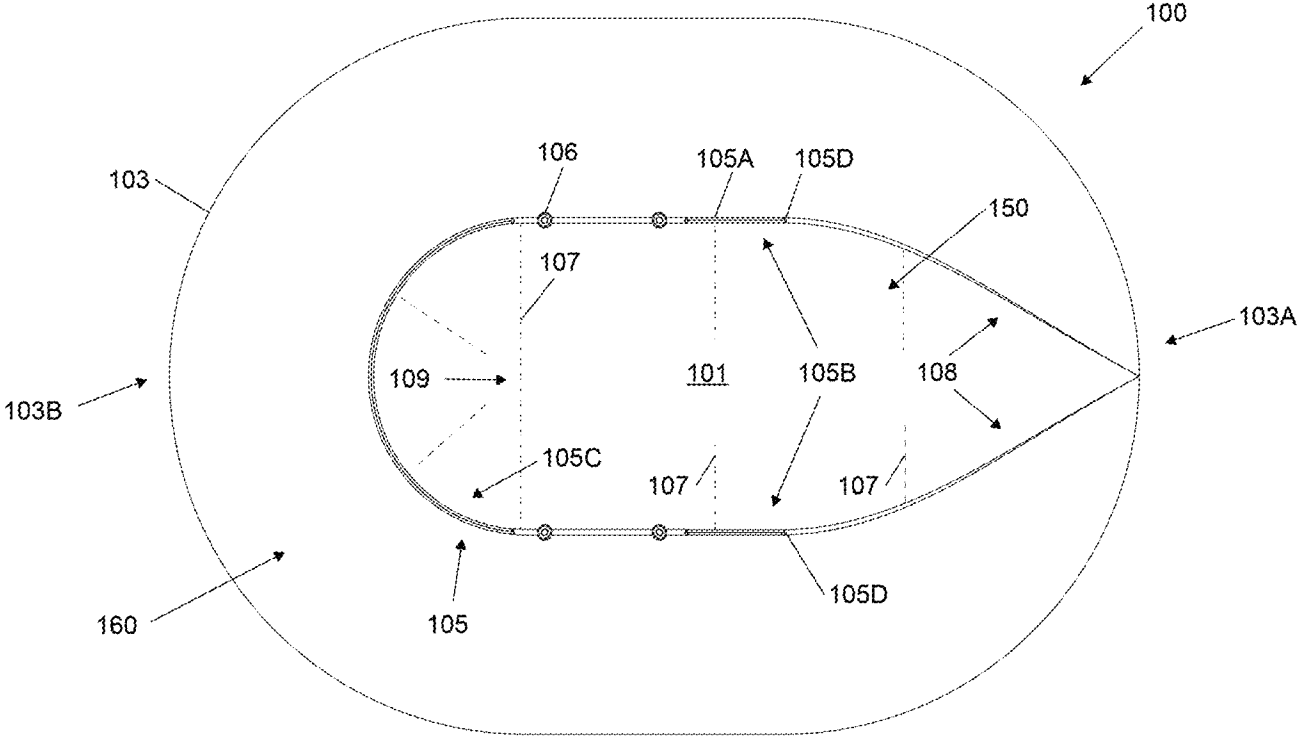
FIG. 1A is a top or plan view of a ventilation partitioner assembly in accordance with certain embodiments.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein.

The terms "left," "right," "front," "rear," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

As used herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DETAILED DESCRIPTION

The present disclosure relates to improved ventilation partitioner assemblies, as well as related systems and methods, that overcome some or all the challenges described above.

In certain embodiments, a ventilation partitioner assembly is designed to be coupled, attached, mounted, installed, and/or connected at or near the output of a climate control system. In some examples described herein, the ventilation partitioner assembly can be positioned or situated at the output or register of a central AC system and/or HVAC system. Additionally, or alternatively, the ventilation partitioner assembly can be positioned or situated at the output of forced-air heating systems, heat pump systems, and/or other types of climate control systems.

The ventilation partitioner assembly described herein can be designed to enhance the distribution of conditioned air within indoor spaces. It features both directing and deflecting capabilities, allowing airflow to be efficiently partitioned and guided to desired areas. The ventilation partitioner assembly can include a director portion that tangentially redirects high-velocity air streams along surfaces, such as ceilings or walls, for extended reach and improved comfort. Simultaneously, the deflector portion can diffuse peripheral airflow, minimizing drafts and promoting uniform air distribution. This dual-function design enables precise control over airflow patterns without obstructing overall system performance or requiring complex installation.

In certain embodiments, the ventilation partitioner assembly can include a design that integrates the director and deflector portions into a unified or integral structure. This structure, including the integrated director and deflector portions, can be designed with precise geometric shaping and/or determinate angles and curvature to achieve the desired airflow patterns and performance described herein. These geometric aspects and determinate features of the design, which are described in further detail below, help ensure consistent and predictable redirection and diffusion of air flow, contributing to the effectiveness of the assembly.

In certain embodiments, the structure of the ventilation partitioner assembly can incorporate a U-shaped partition ridge that can be positioned or situated to face the output or register of a climate control system.

The director portion can refer to the interior section of the U-shaped partition ridge, which operates to redirect ventilation along a surface, such as a ceiling or wall, in some cases. The geometric design of the director portion facilitates the Coanda effect by shaping the airflow into a tangential path along adjacent surfaces, such as ceilings or walls, allowing high-velocity air streams to remain attached to those surfaces for an extended distance and improving the reach and uniformity of ventilation throughout the space. Additionally, this design allows the airflow to be channeled to desired locations, enhancing both the efficiency of the system and the comfort within the space.

In certain embodiments, the interior section within the U-shaped channel, which forms the director portion, can feature a circular-arc scooping profile with a constant radius of curvature. This geometry is designed to maximize the volume of captured airflow while smoothly turning high-velocity air along the curved surface, minimizing turbulence and promoting efficient surface attachment.

The deflector portion can refer to the exterior segment located outside the U-shaped partition ridge, which functions to diffuse and distribute peripheral airflow throughout the room. In some examples, the geometric design of the deflector portion can enable it to spread airflow evenly in multiple directions, reducing the likelihood of drafts and promoting a more uniform air distribution. By diffusing the peripheral air, the deflector portion enhances overall comfort within the space and supports efficient ventilation without obstructing the main flow of conditioned air.

In certain embodiments, the exterior section outside the U-shaped channel, which forms the deflector portion, can be characterized by an oblong, descending flange with an approximately parabolic profile. This extended rim provides a broad, near-horizontal surface that tangentially catches and diffuses peripheral airflow, enabling the air to spread evenly in multiple directions and reducing the likelihood of drafts.

In certain embodiments, the ventilation partitioner assembly can be adapted to interface with, or connect to, conventional HVAC systems to efficiently direct and/or deflect air flow from an output or register in a uniform and evenly distributed fashion throughout a room or environment.

In many scenarios, the airflow that is output via a register of an HVAC or climate control system can include a primary airflow (which can also be referred to as the "first airflow" or "$1^{st}$ airflow") and a peripheral airflow (which can also be referred to as the "secondary airflow, "second airflow," or "$2^{nd}$ airflow"). The primary airflow typically consists of the highest velocity stream exiting the vent, which is most effective for directing conditioned air to specific areas within a space. In contrast, the peripheral airflow is generally lower in velocity and, in some cases, may be diffused outward from the primary airflow.

The design of the ventilation partitioner assembly effectively addresses both the primary and peripheral airflows. As explained throughout this disclosure, the director portion can be specifically shaped to capture and channel the high-velocity primary airflow, guiding it along adjacent surfaces for extended reach and targeted delivery of conditioned air. Meanwhile, the deflector portion can be specifically designed to intercept and diffuse the lower-velocity peripheral airflow, spreading it evenly throughout the room to minimize drafts and promote uniform air distribution. By managing both airflows in a coordinated manner, the partitioner assembly enhances overall ventilation efficiency and occupant comfort without obstructing system performance.

In certain embodiments, the ventilation partitioner assembly can be orientable and/or rotatable in a full 360 degrees along one plane in space, rather than fixed to direct or deflect airflow in one direction.

In certain embodiments, the ventilation partitioner assembly can be designed to both deflect away unwanted downdrafts from the output or register of a climate control system, and direct a portion of wanted ventilation further into a room, without the use of nozzles or secondary constrained flows.

In certain embodiments, the ventilation partitioner assembly can be designed to be detachable or removable, allowing it to be easily connected or disconnected from its position adjacent to a register or output. Various types of releasable connection mechanisms or detachability schemes may be employed to facilitate straightforward installation and removal.

In certain embodiments, the ventilation partitioner assembly can be installed, adjusted, and/or removed without the need for penetrative or permanent fastening into building surfaces and structures.

In certain embodiments, the ventilation partitioner assembly can establish zones of indirect radiant cooling or heating within a space. Blower-driven, or "forced," supply air—whether heated or cooled—transfers its thermal energy to surfaces that absorb or emit heat, such as walls, floors, or ceilings. By selecting the highest CFM airflow from a vent and aligning the direction with the register vanes, the system can project ventilation toward opposing walls, helping to reduce radiant temperature asymmetries as specified by ASHRAE 55 and improving air change rates to better meet ASHRAE 62 requirements.

The ventilation partitioner assembly described herein can provide various benefits and advantages, including:

a. Improved Airflow Distribution: The assembly enables balanced and uniform distribution of conditioned air throughout a space, reducing temperature gradients and enhancing overall comfort for occupants.
b. Extended Reach of Airflow: The geometry of the director portion is specifically shaped to guide high-velocity air streams into a tangential path along adjacent surfaces, enabling the Coanda effect to keep the airflow attached to those surfaces for a greater distance and thereby extending the reach of ventilation throughout the space.
c. Customizable Orientation: The configuration of the assembly allows it to be rotated a full 360 degrees along a plane, enabling users to target airflow to any desired location within a space and/or to direct airflow toward specific surfaces for extended reach.
d. Enhanced Comfort: By minimizing drafts and promoting even air movement, the partitioner helps maintain a consistent and comfortable indoor environment, avoiding areas that are over-conditioned or under-conditioned.
e. Efficient Use of Existing Systems: The design allows for effective airflow management without requiring extensive modifications to existing HVAC systems or ductwork, making it suitable for retrofit applications.
f. Reduced Installation Complexity: The assembly is designed for quick and straightforward installation, often utilizing detachable or releasable connection mechanisms, which eliminates the need for complicated procedures or professional installation.
g. Low Cost: The partitioner can be manufactured and installed at a low cost, making it an accessible solution for a wide range of residential, commercial, and industrial settings.
h. Preservation of System Performance: The assembly operates without constricting airflow or adding undue static pressure to the air handler, ensuring that the overall ventilation capacity of the system is maintained.
i. Health and Safety Benefits: By controlling airflow patterns and reducing turbulence, the partitioner helps limit the spread of airborne contaminants and pathogens, supporting a healthier indoor environment.
j. Zone-Specific Climate Control: The director component allows for targeted delivery of conditioned air to specific areas, enabling more precise control over thermal comfort and radiant temperature asymmetries.
k. Versatility: The assembly can be adapted for use with various types of climate control systems and installed on ceilings, walls, or floors, providing flexibility in application and orientation.

The following discussion describes exemplary embodiments of the ventilation partitioner assembly with reference to the accompanying drawings. It should be recognized that any features or functionalities described for one embodiment in this application may be incorporated into any other embodiment mentioned in this disclosure. Furthermore, the embodiments described herein can be combined in various ways to achieve different configurations and functionalities.

Figure 1B:
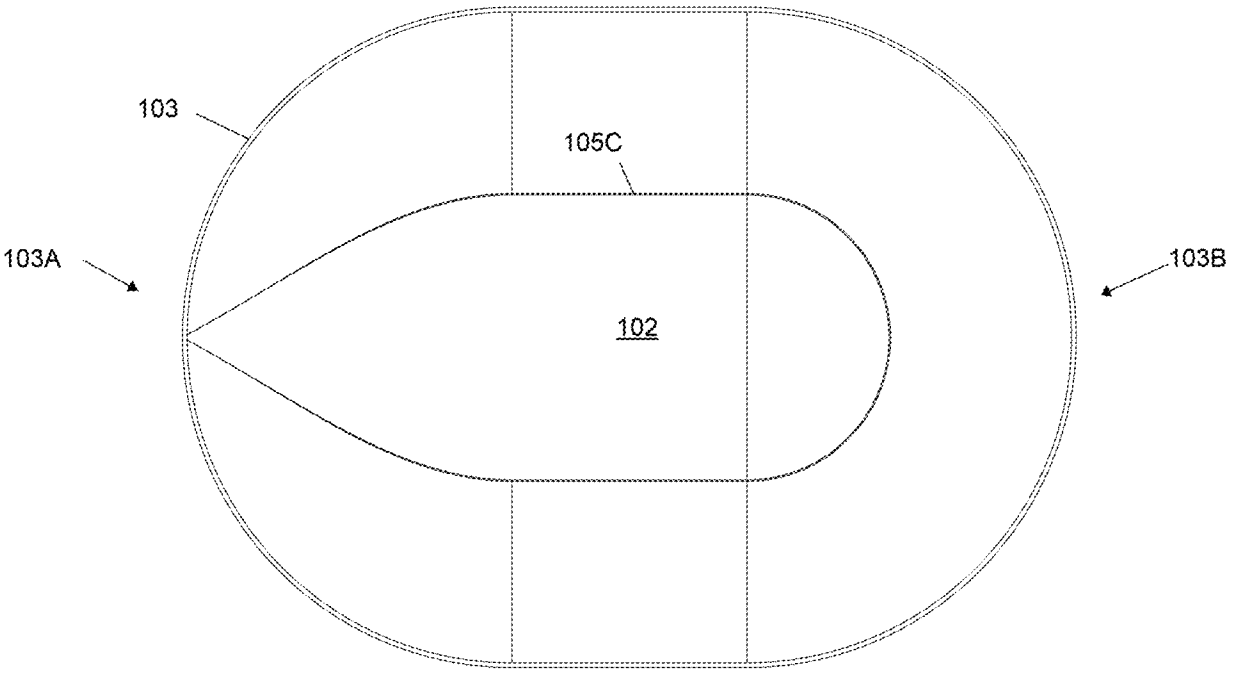
FIG. 1B is a bottom view of the ventilation partitioner assembly illustrated in FIG. 1A in accordance with certain embodiments.
Figure 1C:
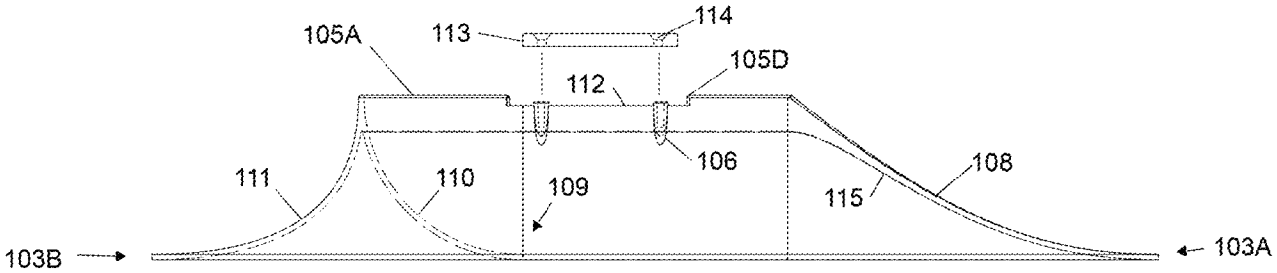
FIG. 1C is a side view of the ventilation partitioner assembly illustrated in FIG. 1A in accordance with certain embodiments.
Figure 1D:
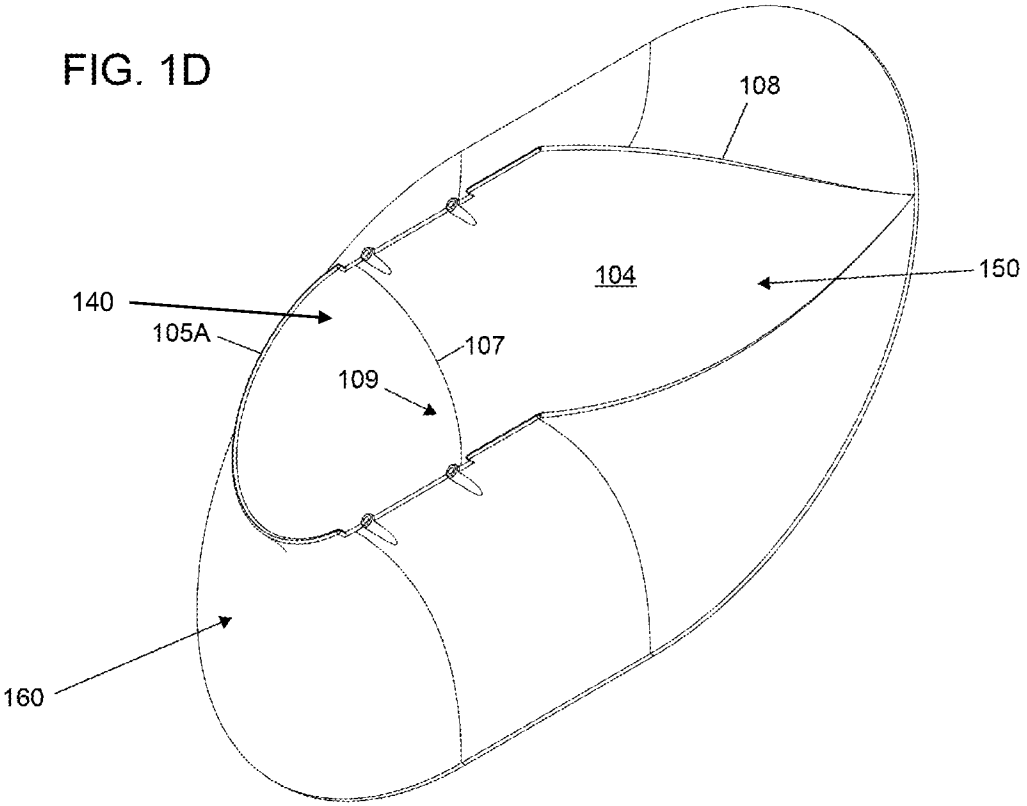
FIG. 1D is an orthogonal projection of the ventilation partitioner assembly illustrated in FIG. 1A in accordance with certain embodiments.
Figure 1E:
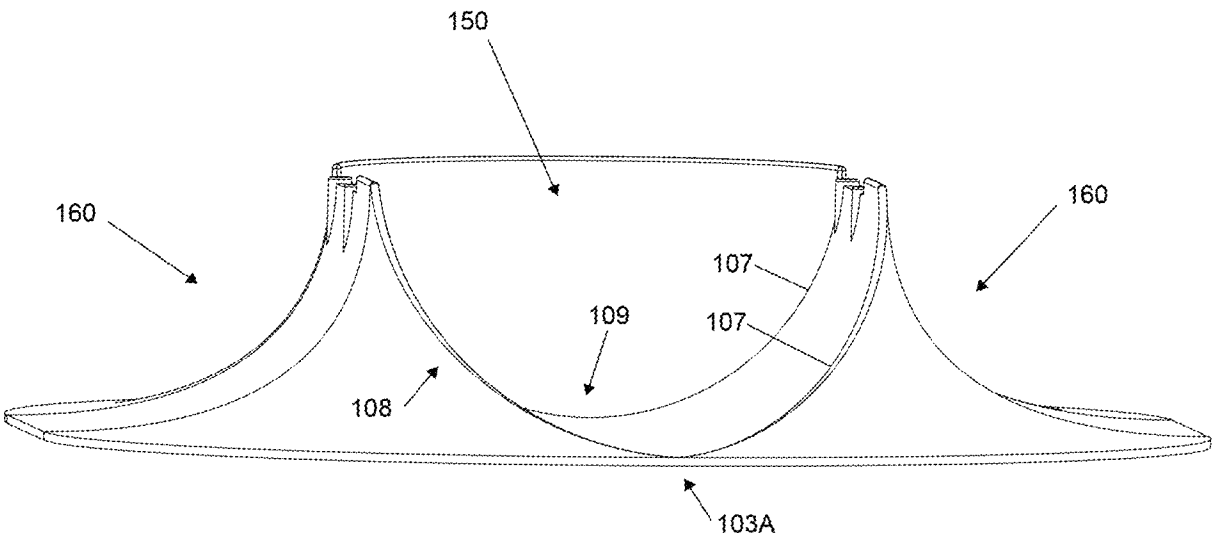
FIG. 1E is a front perspective view of the ventilation partitioner assembly in accordance with certain embodiments.
Figure 1F:
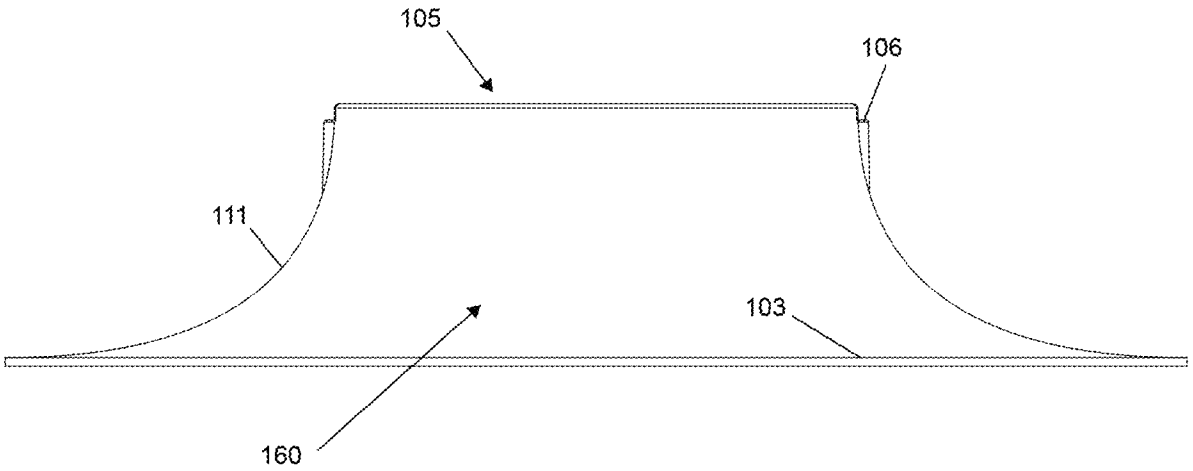
FIG. 1F is a rear view of the ventilation partitioner assembly in accordance with certain embodiments.
Figure 1G:
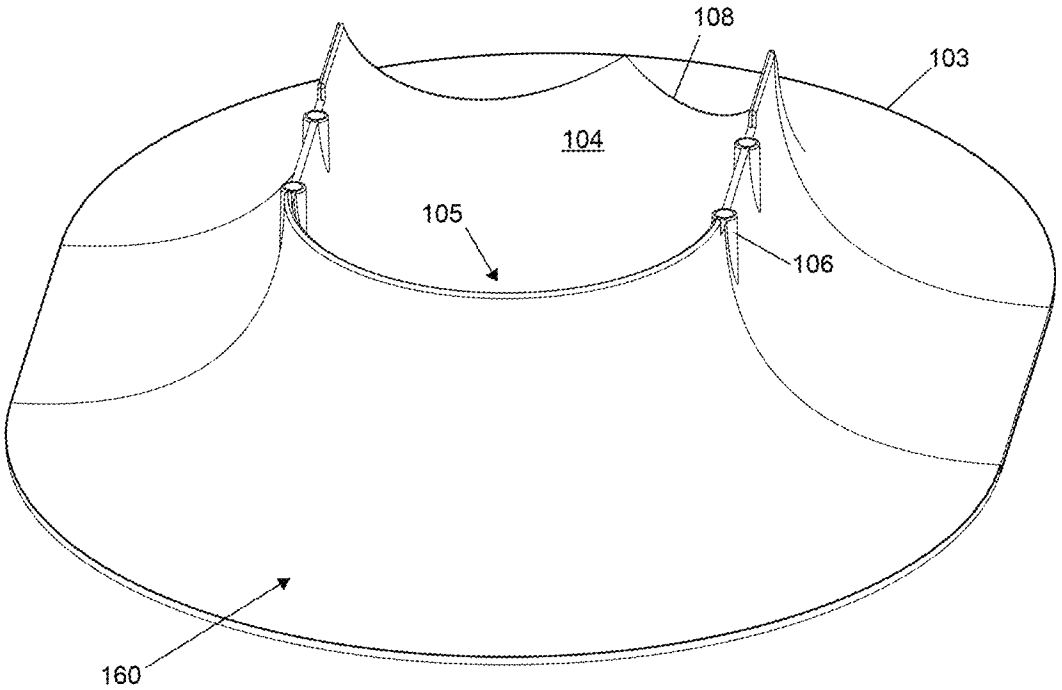
FIG. 1G is a rear perspective view of the ventilation partitioner assembly in accordance with certain embodiments.
Figure 1H:
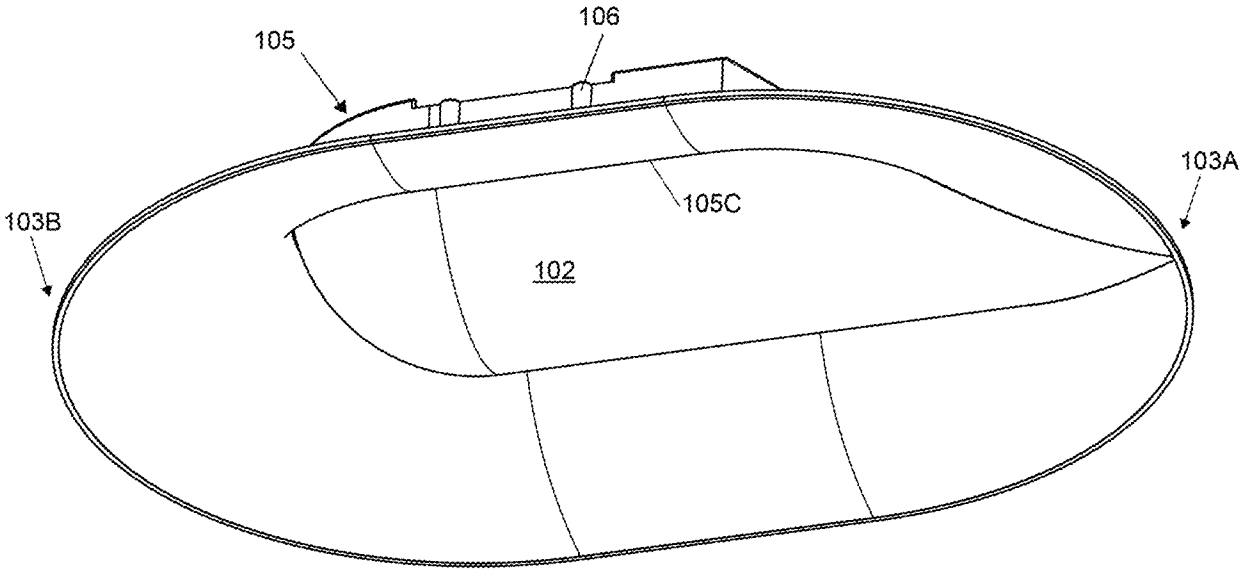
FIG. 1H is a bottom perspective view of the ventilation partitioner assembly in accordance with certain embodiments.

FIGS. 1A-1H illustrate an exemplary embodiment of a ventilation partitioner assembly 100 according to certain embodiments. In particular, FIG. 1A is a top or plan view of the ventilation partitioner assembly 100, FIG. 1B is a bottom view of the ventilation partitioner assembly 100, FIG. 1C is a side view of the ventilation partitioner assembly 100, FIG. 1D is an orthogonal projection of the ventilation partitioner assembly 100, FIG. 1E is a front perspective view of the ventilation partitioner assembly 100, FIG. 1F is a rear view of the ventilation partitioner assembly 100, FIG. 1G is a rear perspective view of the ventilation partitioner assembly 100, and FIG. 1H is a bottom perspective view of the ventilation partitioner assembly 100.

The ventilation partitioner assembly 100 includes a top surface 101 and a bottom surface 102. The top surface 101 and bottom surface 102 meet to form an edge 103 along the periphery of the ventilation partitioner assembly 100. In some embodiments, the bottom surface 102 (see FIGS. 1B and 1H) may be formed as a hollowed shell, creating a negative underside of the top surface 101 (as denoted by dashed line 115 in FIG. 1C) that reduces material usage and weight while maintaining the structural integrity of the ventilation partitioner assembly 100. When installed or positioned at the output or register of a climate control system, the top surface 101 is oriented to face the output or register, while the bottom surface 102 faces away from the output or register.

In the exemplary embodiment illustrated in the drawings, the ventilation partitioner assembly 100 is generally arranged in a circular, oval, or oblong shape as defined by the edge 103 that extends around the periphery of the ventilation partitioner assembly 100. However, in other embodiments, the ventilation partitioner assembly 100 can be arranged in other shapes as well (e.g., in a rectangular shape, square shape, triangular shape, etc.). When the ventilation partitioner assembly 100 is installed, the edge 103 exists in a plane that is parallel or substantially parallel to a surface (e.g., a ceiling, wall, or other surface) which integrates the output or register of the climate control system.

The top surface 101 and bottom surface 102 of the ventilation partitioner assembly 100 extend between a front end portion 103A and a rear end portion 103B. The front end portion 103A is located at one end of the ventilation partitioner assembly 100 that faces the open side of the U-shaped ridge 105, while the rear end portion 103B is positioned at the opposite end that faces the closed side of the U-shaped ridge 105.

The top surface 101 of the ventilation partitioner assembly 100 incorporates a partition ridge 105 that extends upwardly from the top surface 101. Partition ridge 105 divides the ventilation partitioner assembly 100 into its two functional regions, a linear director portion 150 and an outer deflector portion 160. The ridge 105 is shaped to form a continuous U-shaped profile, having a pair of parallel side walls 105B that are spaced apart from each other and a rounded or curved connecting portion 105C that connects to each of the side walls 105B. In some embodiments, the connecting portion 105C is arranged in an arc that spans approximately 180 degrees, wherein each end of the arc connects to a corresponding side wall 105B. This 180-degree arc, as it extends linearly toward the front end portion 103A between the side walls 105B and the descending ridgeline 108, is referred to herein as the half-pipe 107, with its profile clearly illustrated in FIG. 1E.

With reference to FIGS. 1B and 1H, the bottom surface 102 of the ventilation partitioner assembly 100 includes the concave trough 105C that is the underside of the partition ridge 105. In this embodiment, the bottom surface 102 is shown as a hollow region to simplify production and explanation. However, the design of the bottom surface 102 can be modified for aesthetic or functional reasons, or to suit other design requirements. For example, it may be made flat, include a base, and/or be adapted to house a light fixture. Other variations of the bottom surface 102 are also possible.

As shown in FIG. 1C, the inner surface of the U-shaped ridge 105 includes a directing profile 110 that is shaped as a circular arc, and which operates to direct a primary airflow through the conduit 140 formed by the U-shaped ridge 105. The exterior or outer surface of the ridge 105 includes a deflecting profile 111 that is approximately parabolic, which operates to diffuse a peripheral air flow (potentially up to 360 degrees) around the assembly 100.

The partition ridge 105 separates a director portion 150 of the ventilation partitioner assembly 100 from a deflector portion 160 of the ventilation partitioner assembly 100. In doing so, the partition ridge 105 serves as both a physical and functional boundary within the ventilation partitioner assembly 100, delineating the director portion 150 from the deflector portion 160.

An upper rim 105A is formed at the top of the partition ridge 105. When viewed from a top or plan view (see FIG. 1A), the upper rim 105A is arranged in a U-shape that is formed by the crest of the two side walls 105B and the curved connecting portion 105C. At the bottom of the inner side walls, a gradual curvature smoothly transitions into a basin area 109. The basin area 109 is formed within the U-shaped ridge, which is defined by the inner surfaces of the side walls 105B and the inner surface of the curved connecting portion 105C, creating a recessed area with a smooth and continuous curvature that is positioned to capture and guide airflow as it enters the ventilation partitioner assembly 100.

The geometry of the basin area 109, featuring a circular-arc inner scooping profile with a constant radius of curvature, offers distinct advantages for airflow management. This design balances the need for maximal volume within the scoop while efficiently turning forced air downward and outward across the full conduit of the half-pipe 107. Unlike square or parabolic-walled inner scoops, which may provide slightly more volume, the circular-arc profile minimizes turbulence even at low airflow speeds, resulting in smoother and more predictable redirection of air. This reduction in turbulence enhances the effectiveness of the partitioner assembly 100, facilitating better surface attachment and uniform distribution of conditioned air throughout the space.

At reference point 105D, each of the side walls 105B is connected to a descending ridgeline 108, which gradually descends downward as they approach further towards the front end portion 103A. Additionally, unlike the side walls 105B that are arranged parallel or substantially parallel to each other, these descending ridgelines 108 are angled inwardly towards each other until they converge at or near the edge 103 located centrally at the front portion 103A. The pair of descending ridgelines 108 form a V-shaped spur line that extends from the ends of the side walls 105B to a position at or near the edge 103. Conceptually, ridgeline 108 can be understood as being formed by the half-pipe 107 acting as a cutting surface that extends toward the front end portion 103A, intersecting what would otherwise be an oval-shaped circuit or partition ridge. A forward basin 104 is formed within the descending ridgelines 108, which is becomes gradually narrower as it approaches the edge 103.

The director portion 150 is collectively comprised of the interior surfaces of the U-shaped partition ridge 105, the main basin 109, the half pipe 107, the forward basin 104, and the inwardly curving and descending ridgelines 108, which together function to capture, redirect, and channel high-velocity airflow along desired paths within the assembly. When airflow is received in the basin area 109 from above, the smooth curvature of the basin area 109 redirects the air outward through the half-pipe 107 in a direction that is substantially perpendicular to the downward airflow entering the basin.

The demarcation between the conjoined director portion 150 and deflector portion 160 is the contiguous U-shaped ridge and V-shaped descending ridgeline 108. The deflector portion 160 comprises the exterior surfaces of the U-shaped partition ridge 105, which begin at the upper rim 105A and slope downward toward the edge 103 of the assembly. In certain embodiments, these exterior surfaces follow a descending profile that is approximately parabolic in shape, creating a broad, near-horizontal flange that extends outward from the ridge 105. This geometry is designed to tangentially intercept and diffuse airflow, allowing air to spread evenly across the room as it exits the assembly.

The deflector portion 160 comprises the external side walls of both the U-shaped channel and the V-shaped descending ridgeline 108. The deflector portion 160 is specifically designed to intercept and diffuse peripheral airflow as it exits the register or output of a climate control system. Its geometric configuration provides a broad surface that tangentially catches and disperses air in multiple directions. This design enables the deflector to spread airflow evenly throughout the room, reducing the likelihood of drafts and promoting a more uniform air distribution. By diffusing the peripheral air, the deflector portion enhances overall comfort within the space and supports efficient ventilation without obstructing the main flow of conditioned air.

In certain embodiments, the parabolic profile of the deflector portion 160 is specifically configured to redirect the lower-velocity, peripheral airflow as close to a 90-degree angle as possible. The deflector can work in conjunction with existing register vanes, serving as a secondary surface that further guides and bounces the airflow, similar to how a billiard ball uses the sides of a pool table to achieve a sharper turning angle.

The ventilation partitioner assembly 100 can generally incorporate any type of connection or positioning to situate and secure the ventilation partitioner assembly 100 at the output or register of a climate control system. However, the embodiment illustrated in FIGS. 1A-1H demonstrates one particularly advantageous connection mechanism, specifically a magnetic connection scheme that enables the ventilation partitioner assembly 100 to be connected or attached to registers, which are typically constructed of ferromagnetic materials (e.g., such as steel or iron).

In the illustrated connection scheme, the upper rim 105A and/or side walls 105B incorporate a pair of recessed portions 112 that are adapted to receive a pair of magnetic members 113. Receiving channels 106 (e.g., which may include screw bosses or similar types of channels) are integrated into each of the side walls 105B in the regions of the recessed portions 112. When the magnetic members 113 are positioned in the recessed portions 112, the receiving channels 106 are aligned with the openings 114 integrated with magnetic members 113, allowing the magnetic members 113 to be securely fastened in place by connectors (e.g., screws or bolts) that are placed through the openings 114 and into the receiving channels 106. In the illustrated embodiment, the magnetic members 113 are rectangular-shaped and feature countersunk holes for fastening screws or bolts into bosses. However, the magnetic members 113 can be arranged in other shapes and sizes, and other types of connectors also may be utilized to couple the magnetic members 113 to the assembly 100.

In certain embodiments, the recessed portions 112 of the ridge 105 are designed to vertically accommodate or receive the magnetic members 113, enabling the ridge 105 and/or upper rim 105A to sit flush against vent registers while the magnets protrude slightly above the ridge 105 and/or upper rim 105A to ensure strong, direct-contact attachment to the registers, which are typically constructed of ferro-metallic materials. The recessed portions 112 also permit the magnetic members 113 to horizontally pivot in an outward direction, expanding their lateral reach and offering greater flexibility for attachment to various register configurations.

This magnetic connection scheme illustrated in the drawings offers several notable benefits. Amongst other things, it facilitates easy attachment and detachment of the ventilation partitioner assembly, allowing users to quickly install or remove the device without the need for tools or permanent modifications to building surfaces. It leverages the typical construction of HVAC and climate control system registers, which are often constructed from ferromagnetic materials such as steel or iron, to provide a secure, reliable, and non-permanent connection. Additionally, the ability of the magnets to pivot outward provides enhanced flexibility, accommodating a variety of register shapes and sizes and further simplifying the installation process. This approach not only streamlines setup and maintenance but also supports adaptability for different environments and system configurations.

Having described the structure of the ventilation partitioner assembly 100, the following discussion further explains how the assembly 100 facilitates the airflow directing and deflecting capabilities described herein.

The ventilation partitioner assembly 100 may be connected or attached to the output or register of a climate control system (e.g., a HVAC system) using the magnetic connection scheme described above and/or other types of connection schemes. Typically, the airflow output from a climate control system comprises a primary airflow (which can also be referred to as the "first airflow" or "$1^{st}$ airflow") and a peripheral airflow (which can also be referred to as a "secondary airflow, "second airflow," or "$2^{nd}$ airflow"). To optimize the functionality of the ventilation partitioner assembly 100, the director portion 150 of the assembly 100 can be positioned directly beneath the primary airflow.

For example, when the primary airflow is received from above, the smooth continuous basin 109 or scoop segment can redirect the airflow through half-pipe 107, which operates to channel and guide the redirected air toward the central region of the front end portion 103A in a specific direction. Channeling the airflow along the geometry of the director portion 150 extends the reach of the airflow and allows for targeted delivery of conditioned air within a room or enclosed space. Additionally, the assembly 100 can be rotated or oriented in any direction (i.e., 360 degrees), allowing users to adjust the airflow path as needed to target specific areas within the space and further enhance ventilation flexibility and comfort.

In some scenarios, the assembly 100 can be strategically positioned to take advantage of the Coanda effect and maximize airflow reach. By placing the director portion directly beneath the area of highest airflow from the vent, the geometric design guides the high-velocity air stream into a tangential path along nearby surfaces, such as ceilings or walls. By placing basin area 109 to catch 1st flow, attachment to surfaces beyond the partitioner is enhanced, as will be further explained below in association with the Coanda effect. This placement choice and resulting enhanced attachment effect permit supply air to travel farther into the space. By orienting the assembly to align with the strongest airflow and the desired direction, users can achieve optimal ventilation distribution, minimize drafts, and improve overall comfort in the room.

Simultaneously, while the primary airflow from the climate control output is received in the director portion 150, a periphery airflow can be received by the deflector portion 160. The deflector portion 160 is specifically designed to intercept and diffuse this lower-velocity peripheral airflow, spreading it evenly throughout the room to minimize drafts and promote uniform air distribution. By tangentially catching and dispersing the peripheral air, the deflector portion enhances overall comfort and supports efficient ventilation without obstructing the main flow of conditioned air.

In summary, the ventilation partitioner assembly 100 provides a comprehensive solution for managing both primary and peripheral airflows from the output of a climate control system. Its integrated director and deflector portions work in tandem to channel high-velocity air for extended reach and targeted delivery, while simultaneously diffusing lower-velocity air to promote uniform distribution and minimize drafts. By optimizing airflow patterns without obstructing system performance or requiring complex modifications, the ventilation partitioner assembly 100 significantly improves comfort, efficiency, and air quality throughout the space.

Figure 2:
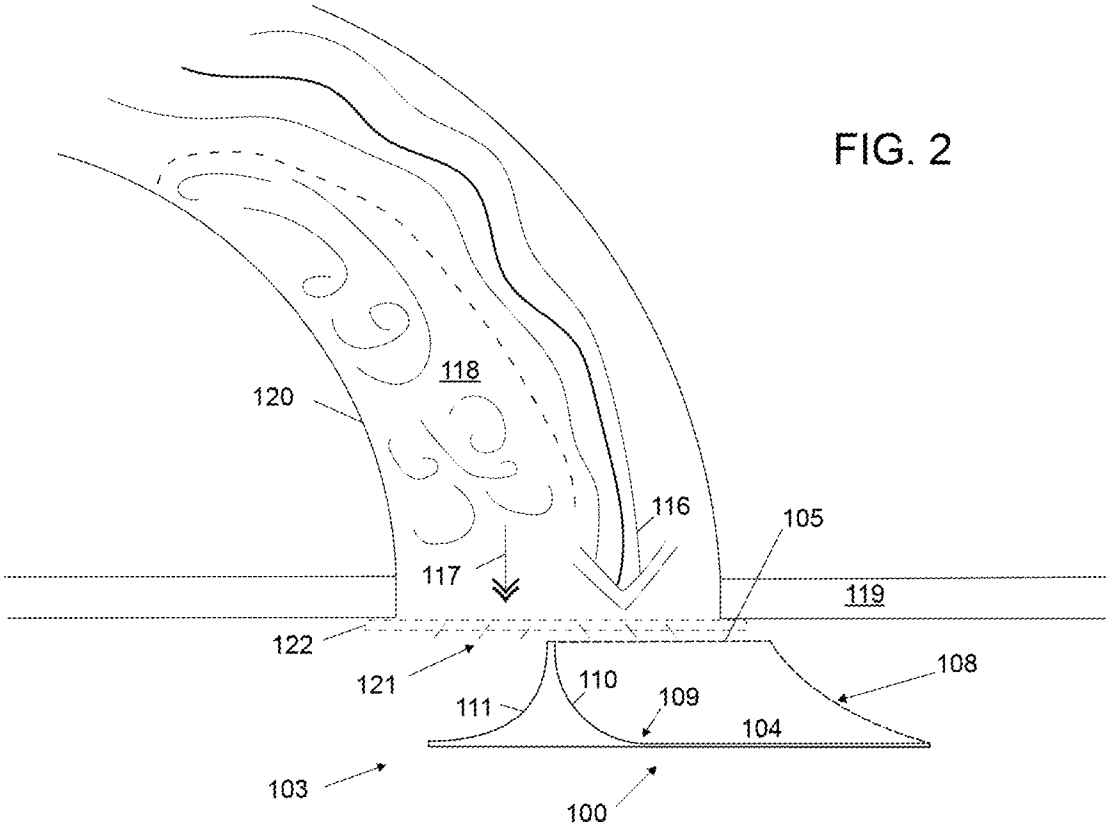
FIG. 2 is a schematic side section illustrating the ventilation partitioner assembly installed at an output of a HVAC system in accordance with certain embodiments.

FIG. 2 is an illustration providing a cross-sectional view of airflow from a climate control system as it is output through a register 122 and directed onto a ventilation partitioner assembly 100, according to certain embodiments. The primary function depicted is the partitioning of supply air into a primary airflow 116 (or "1st air:) and a peripheral airflow 117 ("2nd air"). Additionally, the figure demonstrates the strategic placement of the scooping basin 109 directly beneath the region of maximal primary airflow, optimizing the capture and redirection of conditioned air. A further aspect shown is the alignment of the partition ridge 105 with the register vanes 121, which enhances airflow deflection and promotes low-turbulence flow throughout the space.

The U-shaped ridge 105 serves to delineate the inner focusing channel from the outer diffusing oblong rim 103. This structural feature partitions the supply air into directed and diffused portions, enabling the assembly to manage both targeted and peripheral airflow for improved ventilation distribution.

For optimal projection of ventilated air by the assembly 100, the scooping basin 109 is preferentially positioned beneath the region of maximal primary airflow 116, typically located on one side of the register opening, due to its higher velocity and utility for targeted ventilation. This airflow asymmetry is often caused by centrifugal effects, Dean vortices, and/or flow separation on the convex inner corner of a duct elbow. A turbulent region of vortices 118 develops and stronger airflow shifts toward the outside of the duct elbow 120, while weaker CFM flow 117 occurs along the inside curve of the elbow 120. Air then exits across the register vanes 121, which are illustrated as solid angled lines, with the surrounding metal flange of the register 122 depicted as a dashed rectangular outline.

In the field of HVAC profession, maximal flow is normally found and measured in FPM using a hot-wire anemometer on a telescoping wand. Thus, in some use cases, a user can utilize an anemometer to aid in detecting the precise location of the primary air flow 116. However, such is not necessary and users may rely on tactile sensing with their hand to detect areas of strongest airflow.

Another aspect for optimizing usage of the assembly 100 involves the proper alignment with the register vanes 121. The directing and deflecting profiles 110 and 111 are centered beneath the middle of the register vanes, with both profiles oriented to align with the supply air as directed by the vanes. In some cases, the existing register vanes may direct airflow in a direction that does not match the user's desired ventilation path. In such scenarios, a horizontal turn of up to 90 degrees on the plane of the ceiling and register is preferable, if needed to capture the primary airflow 116. In these instances, the deflector portion 160 can be positioned under adjacent regions of the register to provide a secondary, aligned surface for improved ventilation. For registers without angled vanes, such as floor grilles or standard rectangular wall registers with straight vanes, alignment of the director portion with the register is not required.

Figure 3:
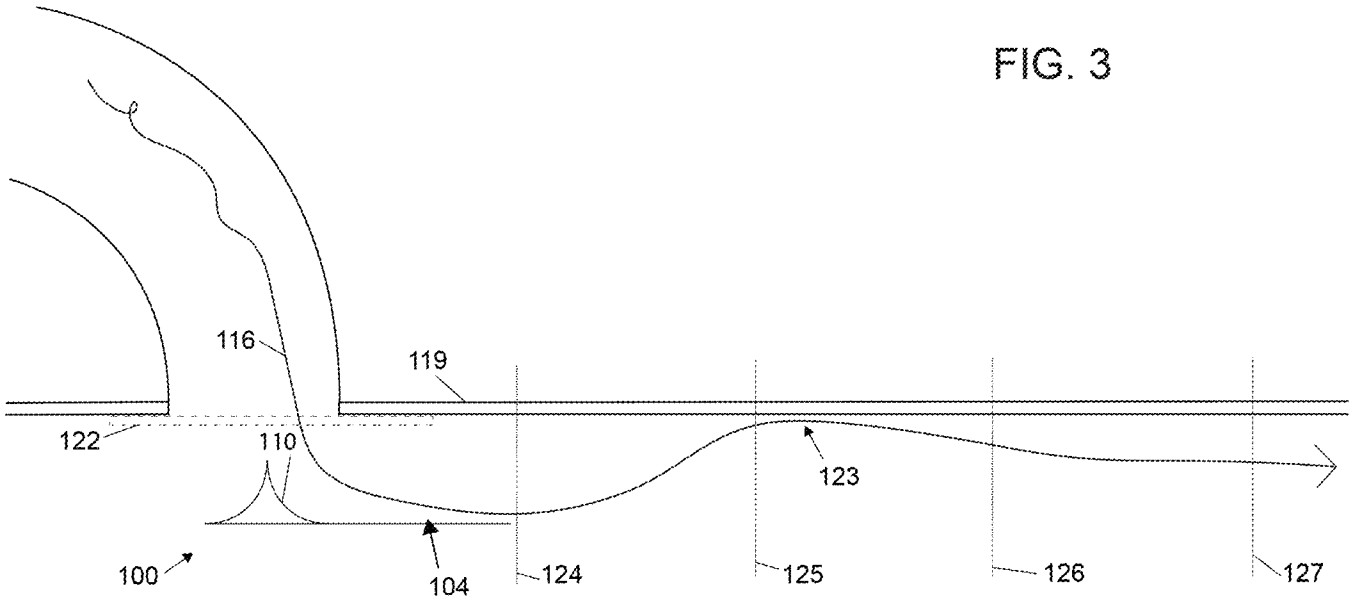
FIG. 3 is a cross-sectional depicting how the ventilation partitioner assembly can facilitate a Coanda-attachment effect in accordance with certain embodiments.

FIG. 3 is a simplified cross-sectional diagram to illustrate the Coanda effect and flow surface-attachment point 123. The Coanda effect of flow attachment is strongest for high velocity jets. However, the physics of a flow preferentially traveling proximate a surface applies at typical HVAC $1^{st}$ air 116 velocities. The Coanda effect manifests when a fluid moving tangentially along a surface remains attached due to viscous forces in the boundary layer that entrain surrounding fluid, creating a low-pressure region that prevents detachment and promotes flow adherence. While some solutions can attempt to prolong flow adherence using higher velocities from jet nozzles, jet flow is unnecessary in a majority of residential and commercial rooms. Merely delaying toroidal mixing diffusion by selecting and tangentially directing $1^{st}$ air 116 with aid from, not dependency on, momentary surface attachment is sufficient to make satisfactory improvements in ventilation.

It has been observed during testing that for assemblies 100 receiving airflow rates between 50 and 150 CFM, the primary air stream 116 is tangentially redirected by the scooping surface of the assembly and aligned as it flows over the forward basin region 104. Due to the Coanda effect, the redirected airflow rises and attaches to the ceiling 119 at attachment point 123. The illustration marks distances from the distal end of the assembly 100, beginning at approximately zero feet 124, then extending to one foot 125, two feet 126, and three feet 127. As the velocity of the airflow declines, the primary stream 116 typically detaches from the ceiling around the two-foot to three-foot marks (126 and 127), after which it drops further below the ceiling 119 beyond the three-foot point 127.

Figure 4:
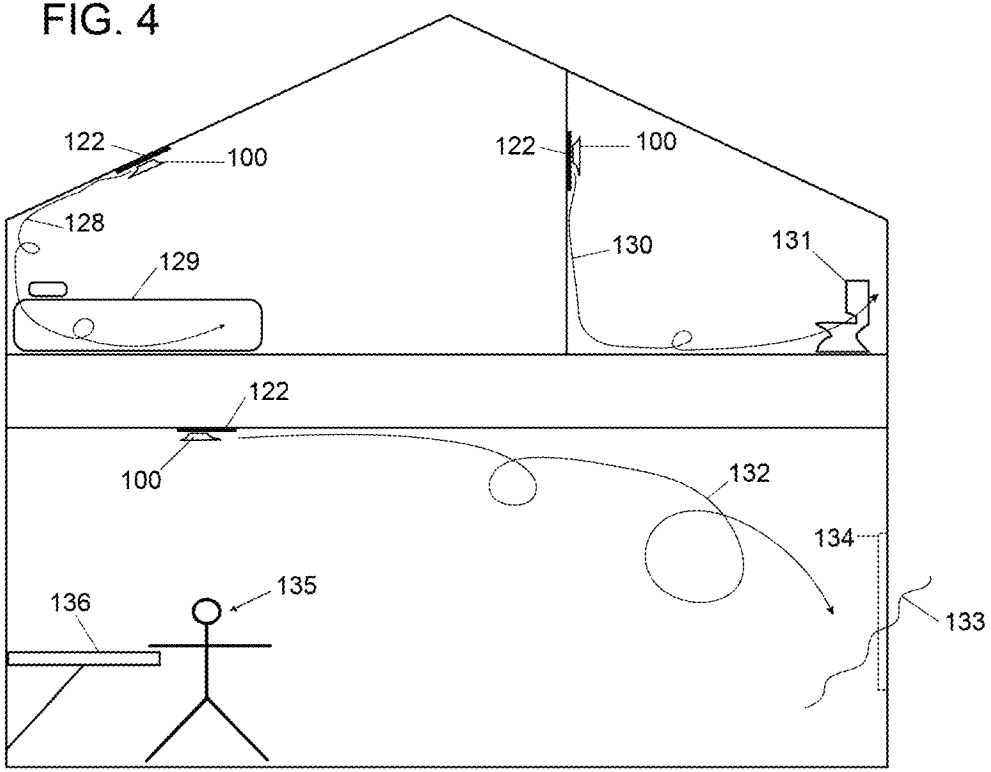
FIG. 4 is an illustration that depicts three exemplary use cases for the ventilation partitioner assembly in accordance with certain embodiments.

FIG. 4 illustrates three typical use cases for the ventilation partitioner assembly 100 within an enclosed space according to some examples. Beginning at the top left and moving clockwise, the figure depicts a bedroom, a bathroom, and an office.

In the bedroom use case, HVAC ventilation exits a vent register 122 in a vaulted ceiling and is tangentially redirected by the assembly 100 along flow path 128. The airflow then cascades behind the bed 129 in a deltoid pattern and spreads diffusely along the floor on either side of the bed, promoting even air distribution throughout the space.

In the bathroom use case, heated ventilation during winter exits register 122 and is redirected by the assembly 100 along flow path 130, causing a significant portion of warm air to flow over and around the toilet 131. This airflow pattern helps prevent heat from immediately rising and pooling at the ceiling, instead maintaining comfortable temperatures on surfaces that occupants frequently contact, such as the floor and toilet.

In the office use case, infrared sunlight 133 warms one side of the room, creating an asymmetric gradient in both radiant surface temperatures and air temperatures from the window 134 to the wall behind the desk 136. In this case, cool conditioned air enters the room through register 122, is directed by the assembly 100, and flows along path 132 toward the sun-facing window 134. Although the register is located far from the primary heat source, the assembly 100 improves room comfort by balancing thermal asymmetries, circulating cool air to distant areas, and enhancing the mean radiant temperature experienced by occupant 135. Without the installation of the assembly 100, register 122 would have directed drafts continuously onto the occupant. However, with the assembly installed, the airflow is redirected and deflected, ensuring ventilation flows comfortably around them.

In certain embodiments, a ventilation partitioner assembly for use with a climate control system can comprise: (a) a top surface that extends between a front end portion and a rear end portion; (b) a partition ridge formed on the top surface that comprises a first side wall, a second side wall, and a connecting portion that connects to the first side wall and the second side wall; (c) a director portion formed by an interior section of the partition ridge that comprises interior surfaces of the first side wall, the second side wall, and the connecting portion, the director portion having a curved profile configured to capture and redirect a primary airflow that is received above from the climate control system tangentially along an adjacent surface; and (d) a deflector portion formed by an exterior section of the partition ridge that comprises exterior surfaces of the first side wall, the second side wall, and the connecting portion, the deflector portion having a descending profile configured to diffuse a peripheral airflow outwardly from the ventilation partitioner assembly. The partition ridge separates the director portion from the deflector portion, and the director portion and the deflector portion facilitate a dual-function design to both direct the primary airflow and diffuse the peripheral airflow received from the climate control system.

In certain embodiments, the partition ridge further can comprise a pair of descending ridgelines that extend from the first side wall and the second side wall toward the front end portion, and the descending ridgelines can be angled inwardly toward each other and converging at or near an edge of the front end portion to form a V-shaped channel configured to guide the primary airflow toward a central region of the front end portion.

In certain embodiments, the director portion can further comprise a half-pipe region formed by a continuous conduit extending between the side walls and the descending ridgelines, and the half-pipe region can be configured to channel the primary airflow from a basin region located near the connecting portion toward the front end portion of the ventilation partitioner assembly.

In certain embodiments, the partition ridge can be arranged in a U-shaped profile, and the connecting portion can comprise a curved segment that joins the first side wall and the second side wall, the curved segment having an arc that spans approximately 180 degrees to form a closed end of the U-shaped profile.

In certain embodiments, a basin region can be formed within the interior surfaces of the partition ridge having the U-shaped profile and the curved segment of the connecting portion, and the basin region can have a circular-arc profile with a constant radius of curvature and being configured to capture and smoothly redirect the primary airflow entering the ventilation partitioner assembly from above.

In certain embodiments, the deflector portion can comprise exterior surfaces of the partition ridge that begin at an upper portion of the partition ridge and slope downward toward an edge of the ventilation partitioner assembly.

In certain embodiments, the exterior surfaces of the deflector portion can include a descending profile that is approximately parabolic in shape.

In certain embodiments, an upper portion of the partition ridge includes a detachable connection mechanism that enables the ventilation partitioner assembly to be removably coupled or attached to an output or a register of the climate control system.

In certain embodiments, the detachable connection mechanism can comprise a pair of magnetic members positioned within recessed portions of the partition ridge, the magnetic members being configured to attach the ventilation partitioner assembly to a ferromagnetic portion of the climate control system.

In certain embodiments, the ventilation partitioner assembly can be configured to be rotatable or orientable in a full 360 degrees along a plane.

In certain embodiments, a ventilation partitioner assembly can comprise: (a) a top surface that extends between a front end portion and a rear end portion; and (b) a partition ridge formed on the top surface that comprises a first side wall, a second side wall, and a connecting portion. Interior surfaces of the first side wall, the second side wall, and the connecting portion can form a conduit extending from the connecting portion toward the front end portion of the top surface, and the conduit formed within the partition ridge can have a continuously curved surface that is configured to capture and redirect an airflow that is received above tangentially along an adjacent surface in a tangential direction towards the front end portion.

In certain embodiments, the partition ridge can further comprise a pair of descending ridgelines that extend from the first side wall and the second side wall toward the front end portion, the descending ridgelines being angled inwardly toward each other and converging to form a V-shaped channel.

In certain embodiments, a half-pipe region can be formed by the conduit extending between the side walls and the descending ridgelines, and the half-pipe region can be configured to channel the airflow from a basin region located near the connecting portion toward the front end portion of the ventilation partitioner assembly.

In certain embodiments, the partition ridge can be arranged in a U-shaped profile, and the connecting portion can comprise a curved segment that joins the first side wall and the second side wall, and the curved segment can have an arc that spans approximately 180 degrees to form a closed end of the U-shaped profile.

In certain embodiments, a basin region can be formed within the interior surfaces of the partition ridge having the U-shaped profile and the curved segment of the connecting portion, the basin region can have a profile with a constant radius of curvature and being configured to capture and redirect the airflow entering the ventilation partitioner assembly from above.

In certain embodiments, exterior surfaces of the partition ridge begin at an upper portion of the partition ridge and slope downward toward an edge of the ventilation partitioner assembly.

In certain embodiments, the exterior surfaces of the partition ridge include a descending profile that is approximately parabolic in shape.

In certain embodiments, an upper portion of the partition ridge includes a detachable connection mechanism that enables the ventilation partitioner assembly to be removably coupled or attached to an output or a register of a climate control system.

In certain embodiments, the ventilation partitioner assembly is configured to be rotatable or orientable in a full 360 degrees along a plane.

In certain embodiments, a system can comprise: (a) a climate control system comprising a register that outputs an airflow; and (b) a ventilation partitioner assembly situated at a location of the register. The ventilation partitioner assembly can comprise: (1) a top surface that extends between a front end portion and a rear end portion; (2) a partition ridge formed on the top surface that comprises a first side wall, a second side wall, and a connecting portion that connects to the first side wall and the second side wall; (3) a director portion formed by an interior section of the partition ridge that comprises interior surfaces of the first side wall, the second side wall, and the connecting portion, the director portion having a curved profile configured to capture and redirect a first portion of the airflow that is received above from the register of the climate control system tangentially along an adjacent surface; and (4) a deflector portion formed by an exterior section of the partition ridge that comprises exterior surfaces of the first side wall, the second side wall, and the connecting portion, the deflector portion having a descending profile configured to diffuse a second portion of the airflow outwardly from the ventilation partitioner assembly. The partition ridge can separate the director portion from the deflector portion, and the director portion and the deflector portion facilitate a dual-function design, which directs both the first portion of the airflow and diffuses the second portion of the airflow received from the climate control system.

It should be recognized that any features and/or functionalities described for an embodiment in this application can be incorporated into any other embodiment mentioned in this disclosure. Moreover, the embodiments described in this disclosure can be combined in various ways.

While various novel features of the invention have been shown, described, and pointed out as applied to particular embodiments thereof, it should be understood that various omissions and substitutions, and changes in the form and details of the systems and methods described and illustrated, may be made by those skilled in the art without departing from the spirit of the invention. Amongst other things, the steps in the methods may be carried out in different orders in many cases where such may be appropriate. Those skilled in the art will recognize, based on the above disclosure and an understanding of the teachings of the invention, that the particular hardware and devices that are part of the system described herein, and the general functionality provided by and incorporated therein, may vary in different embodiments of the invention. Accordingly, the description of system components are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation. Variations, modifications, and other implementations of what is described herein may occur to those of ordinary skill in the art without departing from the spirit and scope of the present invention and its claims.

The invention claimed is:

1. A ventilation partitioner assembly having an interior director portion and an exterior deflector portion configured to redirect a primary and a peripheral airflow received from a register of a climate control system, wherein the primary airflow is redirected by the interior director portion and the peripheral airflow is diffused by the exterior peripheral deflector portion, the ventilation partitioner assembly comprising:

a top surface that faces the register, wherein the top surface extends between a front end portion and a rear end portion with a periphery edge therebetween;

a U-shaped partition ridge formed on the top surface along an interface between the director portion and the deflector portion, wherein the U-shaped partition ridge comprises first and second side walls that are approximately parallel to each other with an arc-shaped connecting portion that connects to the first and second side walls, wherein the U-shaped partition ridge is situated approximately parallel to an adjacent surface that incorporates the register of the climate control system such that the register airflow is delivered in a direction toward the top surface;

the interior director portion formed by an interior section of the U-shaped partition ridge, wherein the interior section comprises interior surfaces of the first and second side walls with the arc-shaped connecting portion, wherein the interior surfaces have a curved profile configured to capture the primary airflow that is received above from the register, and to redirect the primary airflow tangentially along the adjacent surface; and the exterior deflector portion formed by an exterior section of the U-shaped partition ridge, wherein the exterior section comprises exterior surfaces of the first and second side walls with the arc-shaped connecting portion, wherein the exterior surfaces of the exterior deflector portion having have a descending profile configured to diffuse the peripheral airflow, received above from the register, outwardly from the ventilation partitioner assembly;

wherein the interior director portion and the exterior deflector portion facilitate a dual function to both redirect the primary airflow, and diffuse the peripheral airflow, received from the climate control system.

2. The ventilation partitioner assembly of claim 1, wherein the first and second side walls further comprise, or connect to, a pair of descending ridgelines that extend from the first and second side walls, and towards the front end portion, the descending ridgelines being angled inwardly toward each other and converging at or near a periphery edge of the front end portion to form a V-shaped channel configured to guide the primary airflow toward a central region of the front end portion.

3. The ventilation partitioner assembly of claim 2, wherein the interior director portion further comprises a half-pipe region formed by a continuous conduit extending between the interior surfaces of the first and second side walls and the descending ridgelines, the half-pipe region being configured to channel the primary airflow from a basin region located near the arc-shaped connecting portion of the partition ridge, and toward the front end portion of the ventilation partitioner assembly.

4. The ventilation partitioner assembly of claim 1, wherein the arc-shaped connecting portion that joins the first side wall and the second side wall comprises a curved segment having an arc that spans approximately 180 degrees to form a closed end of the U-shaped partition ridge.

5. The ventilation partitioner assembly of claim 4, wherein a basin region is formed within the interior surfaces of the U-shaped partition ridge, the basin region having a circular-arc profile with a constant radius of curvature and being configured to capture and smoothly redirect the primary airflow entering the ventilation partitioner assembly from above.

6. The ventilation partitioner assembly of claim 1, wherein the exterior surfaces of the U-shaped partition ridge begin at an upper portion of the U-shaped partition ridge, and slope downward toward the periphery edge of the ventilation partitioner assembly.

7. The ventilation partitioner assembly of claim 6, wherein the exterior surfaces of the exterior deflector portion include the descending profile and the descending profile is approximately parabolic in shape.

8. The ventilation partitioner assembly of claim 1, wherein an upper portion of the U-shaped partition ridge includes a detachable connection mechanism that enables the ventilation partitioner assembly to be removably coupled or attached to an output or a register of the climate control system.

9. The ventilation partitioner assembly of claim 8, wherein the detachable connection mechanism comprises a pair of magnetic members positioned within recessed portions of the U-shaped partition ridge, the magnetic members being configured to attach the ventilation partitioner assembly to a ferromagnetic portion of the climate control system.

10. The ventilation partitioner assembly of claim 1, wherein the ventilation partitioner assembly is configured to be rotatable or orientable in a full 360 degrees along a plane situated approximately parallel to the adjacent surface.

11. A ventilation partitioner assembly having an interior director portion and an exterior deflector portion configured to partition an airflow received from a register of a climate control system into a primary airflow that is redirected by the interior director portion and a peripheral airflow that is diffused by the exterior deflector portion, the ventilation partitioner assembly comprising:

a top surface that faces the register, wherein the top surface extends between a front end portion and a rear end portion with a periphery edge therebetween; and a U-shaped partition ridge formed on the top surface along an interface between the director portion and the deflector portion, the U-shaped partition ridge comprises first and second side walls that are approximately parallel to each other with an arc-shaped connecting portion therebetween, the U-shaped partition ridge is situated approximately parallel to a building surface that incorporates the register of the climate control system such that the register airflow is delivered in a direction toward the U-shaped partition ridge and the top surface;

wherein interior surfaces of the first and second side walls with the arc-shaped connecting portion together form a conduit extending from the arc-shaped connecting portion toward the front end portion periphery edge of the top surface;

wherein the conduit formed within the U-shaped partition ridge interior surfaces has a continuously curved surface that is configured to capture and redirect the primary airflow;

the continuously curved surface extending from an uppermost portion of the U-shaped partition ridge to a scooping basin that creates a recessed area positioned between the interior surfaces, and extending the continuously curved surface from the scooping basin region located near the arc-shaped connecting portion to half pipe region located between the first side wall and the second side wall;

wherein the interior director portion is configured to capture the primary airflow and redirect the primary airflow along the building surface in a direction that is towards the front end portion and tangential to the surface.

12. The ventilation partitioner assembly of claim 11, wherein the first and second side walls further comprise, or connect to, a pair of descending ridgelines that extend from the first and the second side walls toward the front end portion, the descending ridgelines being angled inwardly toward each other and converging to form a V-shaped channel.

13. The ventilation partitioner assembly of claim 12, wherein a half-pipe region is formed by the conduit extending between the first and second side walls and the descending ridgelines, the half-pipe region being configured to channel the airflow from a basin region located near the arc-shaped connecting portion, and toward the front end portion of the ventilation partitioner assembly.

14. The ventilation partitioner assembly of claim 11, wherein the arc-shaped connecting portion that joins the first side wall and the second side wall comprises a curved segment having an arc that spans approximately 180 degrees to form a closed end of the U-shaped partition ridge.

15. The ventilation partitioner assembly of claim 14, wherein a basin region is formed within the interior surfaces of the U-shaped partition ridge, the basin region having a profile with a constant radius of curvature and being configured to capture and redirect the primary airflow entering the ventilation partitioner assembly from above.

16. The ventilation partitioner assembly of claim 11, wherein exterior surfaces of the U-shaped partition ridge begin at an upper portion of the U-shaped partition ridge and slope downward toward an edge of the ventilation partitioner assembly.

17. The ventilation partitioner assembly of claim 16, wherein the exterior surfaces of the U-shaped partition ridge include a descending profile that is approximately parabolic in shape.

18. The ventilation partitioner assembly of claim 11, wherein an upper portion of the U-shaped partition ridge includes a detachable connection mechanism that enables the ventilation partitioner assembly to be removably coupled or attached to the output or the register of the climate control system.

19. The ventilation partitioner assembly of claim 11, wherein the ventilation partitioner assembly is configured to be rotatable or orientable in a full 360 degrees along a plane situated approximately parallel to the adjacent surface.

20. A system comprising:

a climate control system comprising a register that outputs a first airflow and a second airflow, the register incorporated by an adjacent building surface; and a ventilation partitioner assembly situated downstream of the register, the ventilation partitioner assembly having an interior director portion and an exterior deflector portion configured to partition the airflows received from the register such that the first airflow is redirected by the interior director portion and the second airflow is diffused by the exterior deflector portion, wherein:

a top surface of the ventilation partitioner assembly faces the register and extends between a front end portion and a rear end portion;

a U-shaped partition ridge formed on the top surface between the director portion and the deflector portion, the U-shaped partition ridge comprising a first side wall, a second side wall, and an arc-shaped connecting portion that connects the first side wall to the second side wall, wherein the U-shaped partition ridge being situated approximately parallel to the adjacent building surface such that the airflow that is output from the register is delivered in a direction toward the U-shaped partition ridge and the top surface;

the interior director portion formed by an interior section of the U-shaped partition ridge, the interior director portion comprising interior surfaces extending from the first side wall, the second side wall, and the arc-shaped connecting portion, wherein the interior director portion having a curved profile configured to capture and redirect the first portion of the airflow tangentially along the adjacent building surface;

the exterior deflector portion formed by an exterior section of the U-shaped partition ridge, the exterior deflector portion comprising exterior surfaces extending from the first side wall, the second side wall, and the arc-shaped connecting portion, wherein the exterior deflector portion having a descending profile configured to diffuse the second portion of the airflow outwardly from the ventilation partitioner assembly;

wherein the U-shaped partition ridge separates the interior director portion from the exterior deflector portion, such that the interior director portion and the exterior deflector portion facilitate a dual-function that both redirects the first portion of the airflow received from the register and diffuses the second portion of the airflow received from the register.

* * * * *